United States Patent [19]

Operschall et al.

[11] Patent Number: 4,818,472

[45] Date of Patent: Apr. 4, 1989

[54] METHOD AND APPARATUS FOR THE WET DISMANTLING OF RADIOACTIVELY CONTAMINATED OR ACTIVATED COMPONENTS OF NUCLEAR REACTOR PLANTS

[75] Inventors: Hermann Operschall, Lauf; Robert Weber, Uttenreuth, both of Fed. Rep. of Germany

[73] Assignee: Siemens Aktiengesellschaft, Berlin and Munich, Fed. Rep. of Germany

[21] Appl. No.: 57,178

[22] Filed: Jun. 1, 1987

[30] Foreign Application Priority Data

Jun. 2, 1986 [DE] Fed. Rep. of Germany ... 8614813[U]
Oct. 13, 1986 [DE] Fed. Rep. of Germany ..... 3634876

[51] Int. Cl.[4] ..... G21C 19/00; G21F 9/34

[52] U.S. Cl. ..... 376/260; 29/426.3

[58] Field of Search ..... 376/260, 261, 272, 463, 376/308, 273; 52/249, 741; 29/426.1, 426.3, 426.5, 426.4, 400 N, 723; 83/923

[56] References Cited

U.S. PATENT DOCUMENTS 3,158,546 11/1964 Cordova ..... 376/273
3,755,079 8/1973 Weinstein et al. ..... 376/273
4,483,790 11/1984 Gaiser ..... 376/272
4,568,814 2/1986 Hamasaki et al. ..... 376/310
4,594,774 6/1986 Barker et al. ..... 376/260

OTHER PUBLICATIONS

Nuclear Engineering International, "Decommissioning", 3/87, pp. 39–44.
Electrical World, Feb. 15, 1978, pp. 47/48.

*Primary Examiner*—Deborah L. Kyle
*Assistant Examiner*—Daniel Wasil
*Attorney, Agent, or Firm*—Herbert L. Lerner; Laurence A. Greenberg

[57] ABSTRACT

A method and an apparatus for the wet dismantling of radioactively contaminated or activated components of nuclear reactor plants such as pressure vessels, includes optionally enclosing the component with a jacket or enclosure tube at the end of the service life of the component, the jacket or tube may be cast or molded, providing a sheathing between the component and the jacket, or between the component and a concrete shield, having a thickness sufficient to support at least part of the component after dismantling the component into individual pieces, or joining the jacket to the pressure vessel or to a bottom plate, flooding the component with water for radiation shielding, at least partly dismantling the component into individual pieces through a material-removing tooling or erosion method, and removing the individual pieces.

14 Claims, 6 Drawing Sheets

METHOD AND APPARATUS FOR THE WET DISMANTLING OF RADIOACTIVELY CONTAMINATED OR ACTIVATED COMPONENTS OF NUCLEAR REACTOR PLANTS

The invention relates to a method and an apparatus for the wet dismantling or disintegration of radioactively contaminated or activated components of nuclear reactor plants, wherein the component is provided with a sheathing having a thickness permitting it to perform the supporting function of a receptacle container for at least a part of the component after dismantling or disintegrating the component into individual pieces, the component is flooded with water for shielding radiation, the component is at least partly dismantled into individual pieces by a material-removing tooling or machining method, and the individual pieces are removed.

Dismantling and crushing of a reactor pressure vessel in nuclear power plants is made more difficult by the contamination and activation resulting from neutron bombardment. The resultant radiation load on the operating staff can be kept at a low level by providing short staff exposure times, good shielding against radiation and remote control operation of the equipment.

When radioactive components are disassembled, all of these three criteria are accordingly combined. The disassembly and crushing of a reactor pressure vessel can either be performed dry, i.e., in air, or under water.

During remote-controlled dry dismantling or disintegration, which is performed under suitably shielding conditions using thick shielding plates, poor accessibility causes difficulties in extracting the radioactive elements. Moreover, if trouble is encountered during dismantling, the poor accessibility presents even further difficulties.

During wet dismantling or disintegration, the good shielding effect of the water is exploited. It is known from the journal *Electrical World*, Feb. 15, 1978, page 47/48, to dismantle a demonstration reactor by filling both the safety vessel that surrounds the reactor vessel having the cooling system and the pool for spent and new fuel assemblies with water for shielding against radioactive radiation and by crushing the reactor vessel into small fragments. The fragments are first moved to a storage pool with a crane and are then delivered to a final storage location. With this conventional method, great quantities of radioactive waste are produced and the final storage thereof entails high costs.

FIG. 1 of U.S. Pat. No. 3,158,546 discloses a nuclear power plant having a reactor pressure vessel disposed in a concrete pit, which is lined on the inside with a separate vessel to approximately ⅔ the height of the reactor pressure vessel. This vessel extends only up to a predetermined height of the concrete pit, not up to the height of the reactor pressure vessel, so that the reactor pressure vessel cannot be placed completely under water from the outside.

If a reactor pit of this kind or such a pit that is not lined with an additional vessel were to be flooded for dismantling the reactor pressure vessel, leaks in the concrete and in the liner, if a liner is used, could lead to problems. After many years in operation, fissures in the concrete or in the biological shield which are in fact possible, result in a spreading of the contamination and hence in a greatly increased amount of radioactive waste.

It is accordingly an object of the invention to provide a method and apparatus for the wet dismantling or disintegration of radioactively contaminated or activated components of nuclear reactor plants, which overcomes the hereinafore-mentioned disadvantages of the heretofore-known methods and devices of this general type, and which enables dismantling to be performed with simple means, while avoiding the spread of contamination into the biological shield even when the biological shield surrounding the component is not lined in advance with a water-tight vessel.

With the foregoing and other objects in view there is provided, in accordance with the invention, a method for the wet dismantling of radioactively contaminated or activated components of nuclear reactor plants, which comprises enclosing the component with a jacket at the end of the service life of the component, providing a sheathing between the component and the jacket having a thickness sufficient to support at least part of the component after dismantling the component into individual pieces, flooding the component with water for radiation shielding, at least partly dismantling the component into individual pieces through a material removing method, and removing the individual pieces.

With the objects of the invention in view there is also provided an apparatus for the wet dismantling of radioactively contaminated or activated components of nuclear reactor plants, comprising a jacket enclosing the component, and a sheathing in the form of shielding material disposed between the component and the jacket, the sheathing having a thickness sufficient to support at least a part of the component after dismantling the component into individual pieces.

With the objects of the invention in view there is additionally provided a method for the wet dismantling of a radioactively contaminated or activated reactor pressure vessel disposed inside a reactor pit and spaced from a concrete biological shield defining a gap between the pressure vessel and the shield, which comprises severing coolant lines and closing connector stumps of the reactor pressure vessel, subsequently filling the gap between the pressure vessel and the shield by casting or injection molding forming a sheathing having a thickness sufficient to support at least part of the component after dismantling the component into individual pieces, flooding the component with water for radiation shielding, at least partly dismantling the component into individual pieces through a material removing method, and removing the individual pieces.

With the objects of the invention in view there is furthermore provided an apparatus for the wet dismantling of a radioactively contaminated or activated reactor pressure vessel disposed inside a reactor pit and spaced from a concrete biological shield defining a gap between the pressure vessel and the shield, comprising a sheathing filling the gap between the reactor pressure vessel and the shield by casting or injection molding after severing coolant lines and closing connector stumps of the reactor pressure vessel, the sheathing having a thickness sufficient to support at least part of the component after dismantling the component into individual pieces.

With the objects of the invention in view there is also provided a method for the wet dismantling of a radioactively contaminated or activated pressure vessel of a nuclear reactor plant, which comprises placing a bottom plate with a given diameter below the reactor pressure vessel, enclosing the pressure vessel with an enclosure tube having a lower end with the given diameter, tightly joining the lower end of the tube to the bottom plate, flooding the pressure vessel with water for radiation shielding, at least partly dismantling the pressure vessel into individual pieces through a material removing method, and removing the individual pieces.

With the objects of the invention in view there is additionally provided an apparatus for the wet dismantling of a radioactively contaminated or activated pressure vessel of a nuclear reactor plant, comprising a bottom plate with a given diameter disposed below the reactor pressure vessel, and an enclosure tube enclosing the pressure vessel, the tube having a lower end with the given diameter tightly joined to the bottom plate.

With the objects of the invention in view there is furthermore provided an apparatus for the wet dismantling of a radioactively contaminated or activated pressure vessel of a nuclear reactor plant having a bottom with a given diameter, comprising an enclosure tube enclosing the pressure vessel, the tube having a lower end with the given diameter tightly joined to the bottom of the pressure vessel.

The advantages attainable with the invention are above all that it can be adapted to the most varied conditions in a reactor building and is therefore highly flexible.

Typically, the thermal insulation formed of individual modules which is secured to the inner periphery of the biological shield and correspondingly the thermal insulation elements disposed on the bottom, are removed prior to the disposition of the sheathing. The dismantling or disintegration can be performed successively and the individual pieces can be removed from the sheathing and deposited in a spent fuel cooling pool or in a barrel for final storage. Prior to the disposition of the sheathing by integral casting or extrusion coating, in order to reinforce the sheathing and make it stronger, it may be suitable to provide the component with a framework or a skeleton of a reinforcement, which is suitably formed of annular members and jacket members, so that the result is a reinforcement network that covers the entire outer surface of the component. This network is then joined to or cast integral with the casting compound of the sheathing.

When an enclosure tube is used, the outer diameter thereof is preferably dimensioned in such a way as to leave the smallest possible air gap between the tube and the reactor pit.

Other features which are considered as characteristic for the invention are set forth in the appended claims.

Although the invention is illustrated and described herein as embodied in a method and apparatus for wet dismantling or disintegration of radioactively contaminated or activated components of nuclear reactor plants, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
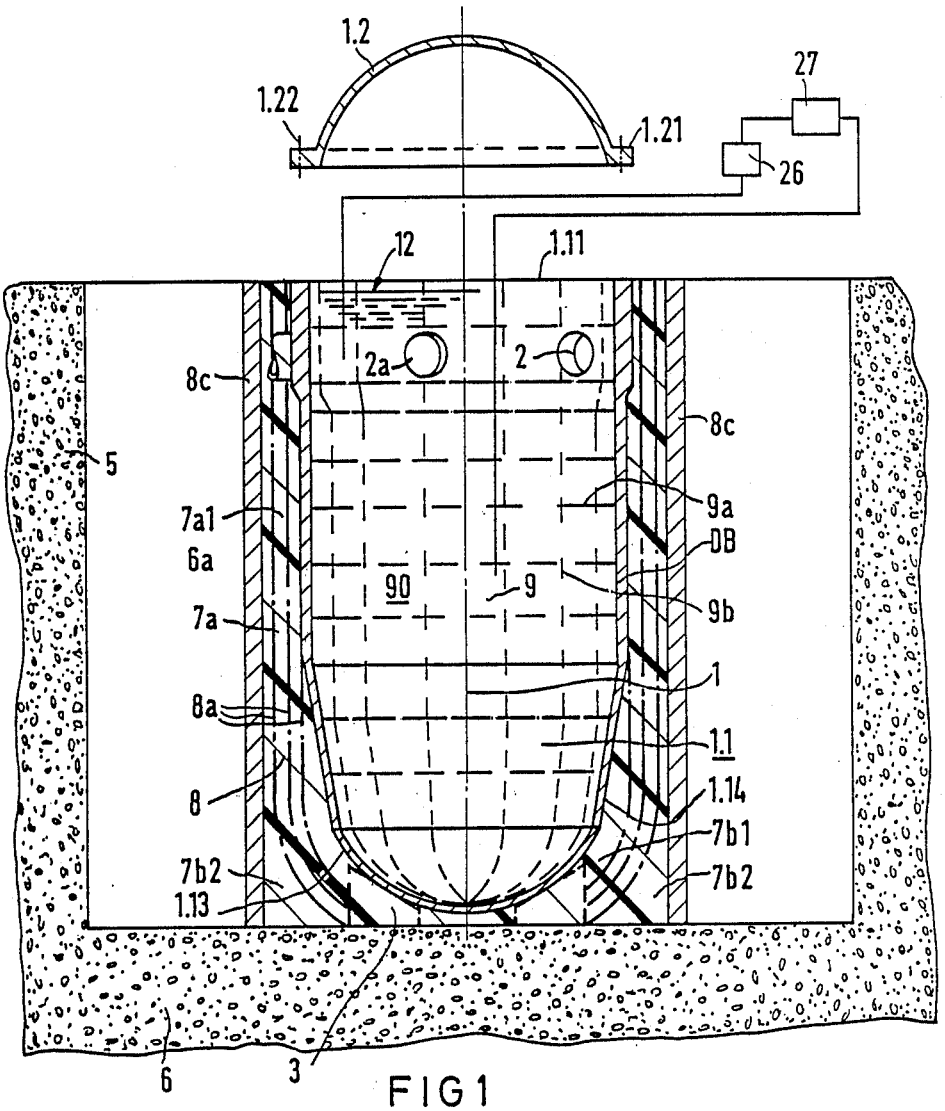
FIG. 1 is a fragmentary, diagrammatic, cross-sectional view of a vessel of a heat exchanger.

Referring now to the figures of the drawings in detail and first, particularly, to FIG. 1 thereof, there is seen a component in the form of a vessel DB of a heat exchanger for a nuclear power plant which has a lower part 1.1 and a cover 1.2, to be mounted on a vessel flange 1.11 normal to the longitudinal axis 1' of the vessel; the cover has an annular flange 1.21 and screws 1.22 distributed over the periphery thereof in the vicinity of the cover flange. The cover screws 1.22 are anchored in the cover flange 1.21 of the bottom portion in suitably threaded bores. The vessel DB, hereinafter referred to as the pressure vessel DB, has a substantially hollow cylindrical shape with a spherical bottom 1.13 and a conical transition 1.14 between the cylindrical portion and the spherical bottom 1.13. A connector portion of the pressure vessel, where line connectors or sockets 2 are disposed, is located in the vicinity of the reinforced cover flange 1.21. The pressure vessel DB is mounted on a supporting ring structure with support claws 3. Reference numeral 5 designate a biological shield in the form of a concrete structure; reference numeral 6 designates a concrete structure on the bottom of the reactor building; and an annular gap *7a* remains between a jacket or shell *8c* and the pressure vessel DB, while an approximately hollow-conical space *7b* remains in the vicinity of the spherical bottom 1.13.

Figure 2:
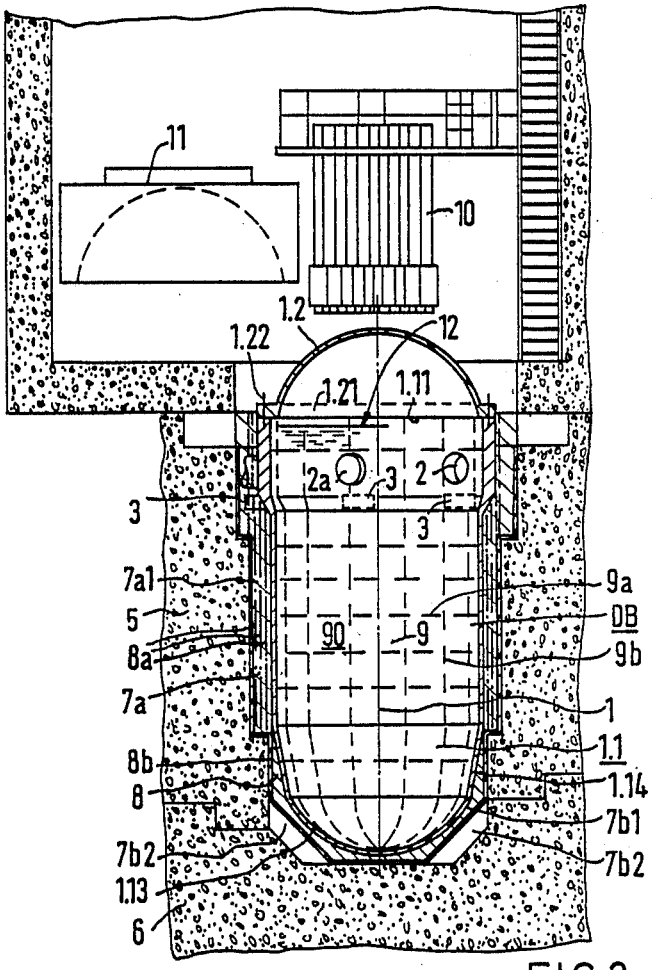
FIG. 2 is a fragmentary cross-sectional view of a reactor pressure vessel.

A portion ***7a*1 of the annular gap *7a* and a portion *7b*1 of the space *7b* on the bottom are filled with a sheathing 8 for the pressure vessel DB, which is shown in cross section. The sheathing 8 has a thickness which permits the sheathing to perform a supporting function for a receptacle or decontamination tank for at least a part of a component DB that is to be dismantled or disintegrated into individual pieces 9. However, prior to supplying the sheathing, the cover 1.2 along with a cover insulating hood 11 seen in FIG. 2 is raised and moved into a temporary storage position. For shielding reasons, the pressure vessel DB is also filled with water to a level just below the flange 1.11, such as up to a level line 12. For the sake of good viewing conditions, it is favorable for the water to be cleaned continuously during the dismantling or disintegration by means of a water cleaning system, which has a pump 26 and filter 27. The component DB is then dismantled or disintegrated from above by a processing method involving removal into the individual pieces 9, using a non-illustrated manipulator having a tool head; the individual pieces are defined by removal or cutting lines in the form of horizontal system lines *9a* and surface or jacket lines *9b***, which will be described in further detail below.

The sheathing 8 is advantageously formed of shielding material, in particular a concrete shielding jacket provided with a reinforcement 8*a*. It is also possible to use a tough plastic material capable of being cast or injected, as the sheathing. The plastic material is preferably reinforced as well, for instance with a network of cables formed of glass-fiber-reinforced polyester which are capable of absorbing high tensile strain. Before a network of this kind can be lowered into the annular gap and the integral casting can be started, all of the obstructions that may possibly be present in the annular gap must be removed. The network is then braced on the bottom in basket-like fashion by means of fixtures, so that it encompasses the entire lower portion of the pressure vessel DB. Subsequently or even previously, the bottom region of the concrete structure 6 surrounding the pressure vessel DB is suitably provided with a separation layer 8*b*, which is applied by remote control. The layer 8*b* may be in the form of separation foils, which are disposed on the inner wall of the shell or concrete structure together with the reinforcement network for the sheathing. The material for the sheathing itself is then introduced by casting or by extrusion filling of the spaces 7*a*1 and 7*b*1, and the wedge-shaped spaces 7*b*2 in the vicinity of the spherical bottom 1.13 are also suitably filled by means of filler pieces, since complete filling by casting is not necessary in these areas. Naturally, before the shielding water is introduced into the pressure vessel DB, the line connectors 2, which are truncated elements produced by severing the remaining parts of the primary coolant lines, are sealed off from inside by sealing bodies 2*a*; these connectors are likewise jacketed or lined by the sheathing 8, as are the support claws 3. The line connectors 2 and/or the claws 3 can then be used for attaching supporting cables of a non-illustrated construction crane.

The pressure vessel DB and the sheathing 8 are then prepared to such an extent that with a non-illustrated manipulator and tool head, it is possible to move into the interior of the vessel from above. In order to perform the dismantling or disintegration into the individual pieces 9 along the removal or cutting lines 9*a*, 9*b*, chip-removing methods such as turning, milling, sawing or arc sawing are suitable. The advantage provided by such a process is that the water that fills the pressure vessel DB simultaneously provides the required cooling. However, it is also possible to use a chemical or electrochemical erosion method under water. If an electrolyte suitable for electrochemical erosion is used as a shielding liquid, then this liquid need merely be set into circulation by suitable pumps at the locations at which the electrodes are in operation at a particular time. As the system and surface lines 9*a*, 9*b* show, the component DB is dismantled or disintegrated into many wall pieces 9 by making circumferential grooves and/or longitudinal grooves or slits. It is possible for the component DB to first be dismantled or disintegrated into individual courses 90 by removal along the inside system or circumference lines 9*a*. The work is suitably performed progressively from top to bottom. The upper courses can then be lifted out as needed and moved to a temporary storage location. However, if the sheathing 8 is dimensioned in such a way as to support the entire weight of the component DB, then after suitable dismantling or disintegration of the component into the courses 90, dismantling or disintegration into the individual wall pieces 9 is suitably performed by tooling, machining or erosion along the surface lines 9*b*. The work is then preferably performed from top to bottom. With the use of such a method, further processing of portions located farther down cannot be hindered by wall pieces that become detached by themselves, because the separated wall pieces are held firmly by the adhesion of the wall pieces to the sheathing 8, unless they are removed by a gripping tool.

Once the dismantling or disintegration of the component DB into the individual wall and bottom pieces 9 has been completed, some of the shielding water can be pumped out, because the pieces 9 can be piled up in the vicinity of the spherical bottom. A closure cover, preferably made of the same casting compound as the sheathing 8, is then suitably placed on the upper rim of the sheathing 8 and joined to it, preferably by being cast onto it.

As FIG. 2 shows, the method according to the invention can also be used in the dismantling or disintegration of a reactor pressure vessel. Prior to supplying the sheathing, the cover 1.2 of the reactor pressure vessel, together with control rod tubes 10 and the cover insulating hood 11, is raised and moved to a temporary storage position. The inner periphery of the biological shield 5 and the bottom region of the concrete structure 6 surrounding the pressure vessel DB are provided with the separation layer 8*b*, which is preferably applied by remote control using spray lances.

Figure 3:
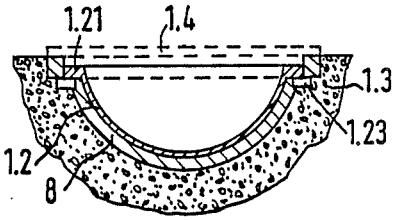
FIG. 3 is a fragmentary cross-sectional view of a cover which has been removed from the reactor pressure vessel according to FIG. 2 and provided with a sheathing.

The same removal process as that described for the lower part 1.1 of the vessel is preferably also performed for the cover 1.2 of the reactor pressure vessel shown in FIG. 3; that is, the cover 1.2 is set in a hollow concrete form 1.3 by connectors 1.23, sheathed with a supporting sheathing 8 and then crushed.

Figure 4:
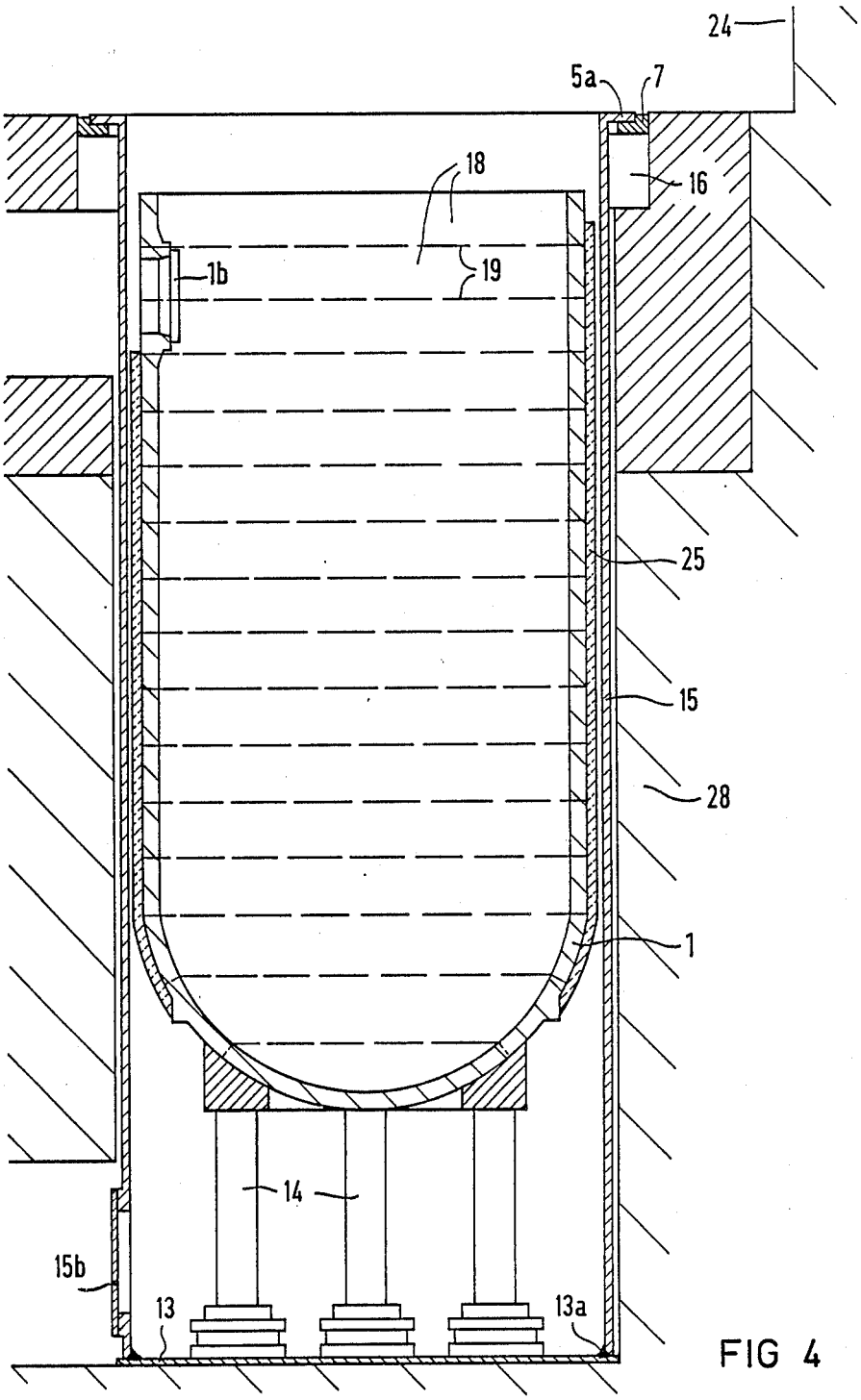
FIG. 4 is a fragmentary cross-sectional view of an apparatus for wet dismantling or disintegration of a reactor pressure vessel.
Figure 5:
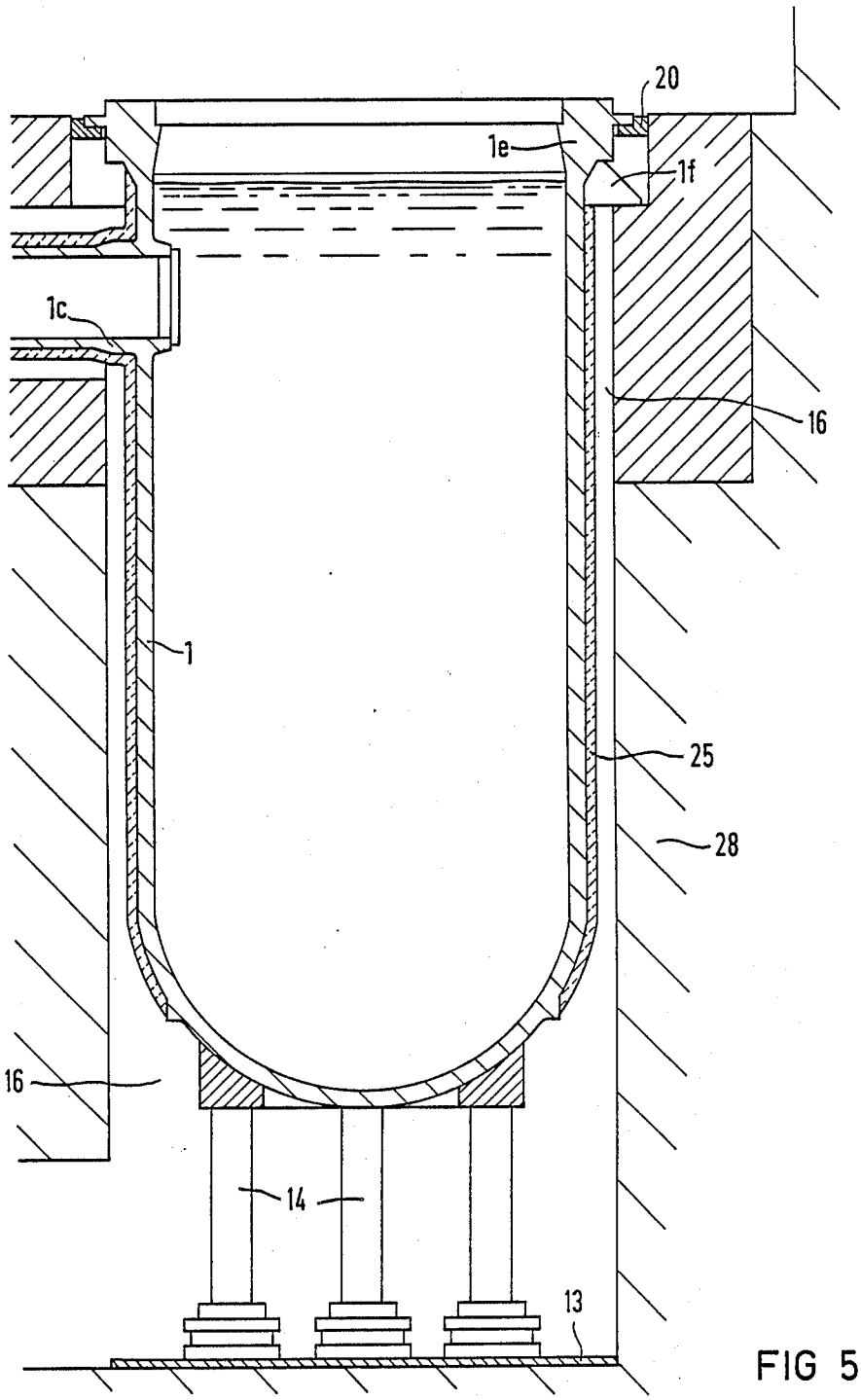
FIG. 5 is a fragmentary cross-sectional view of a reactor pressure vessel prior to the dismantling or disintegration, with a substitute brace or suport already in place and a sealing bottom.

In FIG. 4, a reactor pressure vessel 1 is disposed inside a biological shield 28, which forms a reactor pit (concrete shielding) 16 seen in FIG. 5. A bottom plate 13, which may be made of steel, is disposed on the bottom of the shield 28 below the reactor pressure vessel.

The vessel is provided with substitute or replacement supports or braces 14 for wet dismantling or disintegration of the reactor pressure vessel 1. The upper supports or braces (support claws) and all of the parts that discharge into the reactor pressure vessel 1, especially lines 1*c* shown in FIG. 5, are removed, as are support structures 1*f* in the upper region of the reactor pressure vessel 1, which are also shown in FIG. 5. The shell or enclosure tube 15 shown in FIG. 4 is then introduced between the reactor pressure vessel 1 and the biological shield 2. The diameter of the enclosure tube 15 is adapted to the diameter of the bottom plate 13 inserted into the reactor pit; the bottom plate can also be in the form of a tank or tub. Once the enclosure tube 15 which is provided with a manhole 15*b* has been introduced, it is joined tightly to the bottom plate 13 which is built in underneath the reactor pressure vessel 1, such as by means of a welded seam 13*a*. A flange 15*a* at the top of the enclosure tube 15 is joined to a flooding pit or well 24 by means of a seal 17.

As a result of the flooding of the enclosure tube 15, the outside of the reactor pressure vessel is underwater as well and in this way it can be separated into suitable sections.

The sequence of the steps in the dismantling and crushing of the reactor pressure vessel may, for instance, be in the following order (with the fuel assemblies and built-in core parts removed and the reactor and the flooding chamber flooded):

(A) lowering of the water level far enough that it is just below the lower edge of a flange 1*e* of the reactor pressure vessel, as seen in FIG. 5;

(B) installation of a seal 1*b* shown in FIG. 4 on the inside of the coolant inlet and outlet connectors and other auxiliary lines from the inside of the reactor pressure vessel 1 towards the outside;

(C) introduction and completion of the bottom plate 13 underneath the reactor pressure vessel 1, installation of the replacement or substitute supports or braces 14 on the bottom of the reactor pit;

(D) disassembly of a seal 20 shown in FIG. 5 between the flange of the reactor pressure vessel 1 and the lining of the flooding chamber;

(E) severing of all of the parts of the reactor pressure vessel that obstruct the installation of the enclosure tube (such as the upper support structures 1*f* and the connectors of the lines 1*c*);

(F) severing, for instance by milling or arc sawing while dry, lifting out and removing the non highly-radioactive reactor pressure vessel flange 1*e* shown in FIG. 5;

(G) installation of the enclosure tube 15 seen in FIG. 4;

(H) sealing the enclosure tube 15 with the bottom plate 13, for instance by welding;

(I) possibly sealing the enclosure tube 15 with the flooding pool 24 by installation of the seal 17;

(K) flooding the enclosure tube 15 up to the vicinity of the upper end thereof; and (L) annularly severing wall pieces 18 of the reactor pressure vessel along separation lines 19 and crushing them, as well as thermal insulation 25 that may still be present on the outside of the reactor.

The enclosure tube 15 is used as a sealing element with respect to the reactor pit 16 and has the following functions:

(a) Holding the water surrounding the reactor pressure vessel. The water is used for shielding the radiation of the reactor pressure vessel, the sections thereof and the biological shield (liner, reinforcing irons), toward the top;

(b) Catching secondary waste (contaminants, etc., that are filtered out) which is produced during the separation of the reactor pressure vessel by the separating equipment located in the enclosure tube;

(c) Providing a temporary storage location for the reactor pressure vessel sections and as a transfer site;

(d) Holding the separation equipment necessary for the dismantling or disintegration of the reactor pressure vessel;

(e) Providing water which serves as a coolant for the separating equipment;

(f) Avoidance of spreading contamination into the biological shield; and (g) Shielding the radiation of the concrete reactor pit (biological shield) in the course of possible installation of a new reactor pressure vessel.

The severing of the inlet and outlet connectors and of the reactor flange and reactor pressure vessel brackets, and the introduction of the enclosure tube 15, are performed from locations that have only a low radiation exposure.

Figure 6:
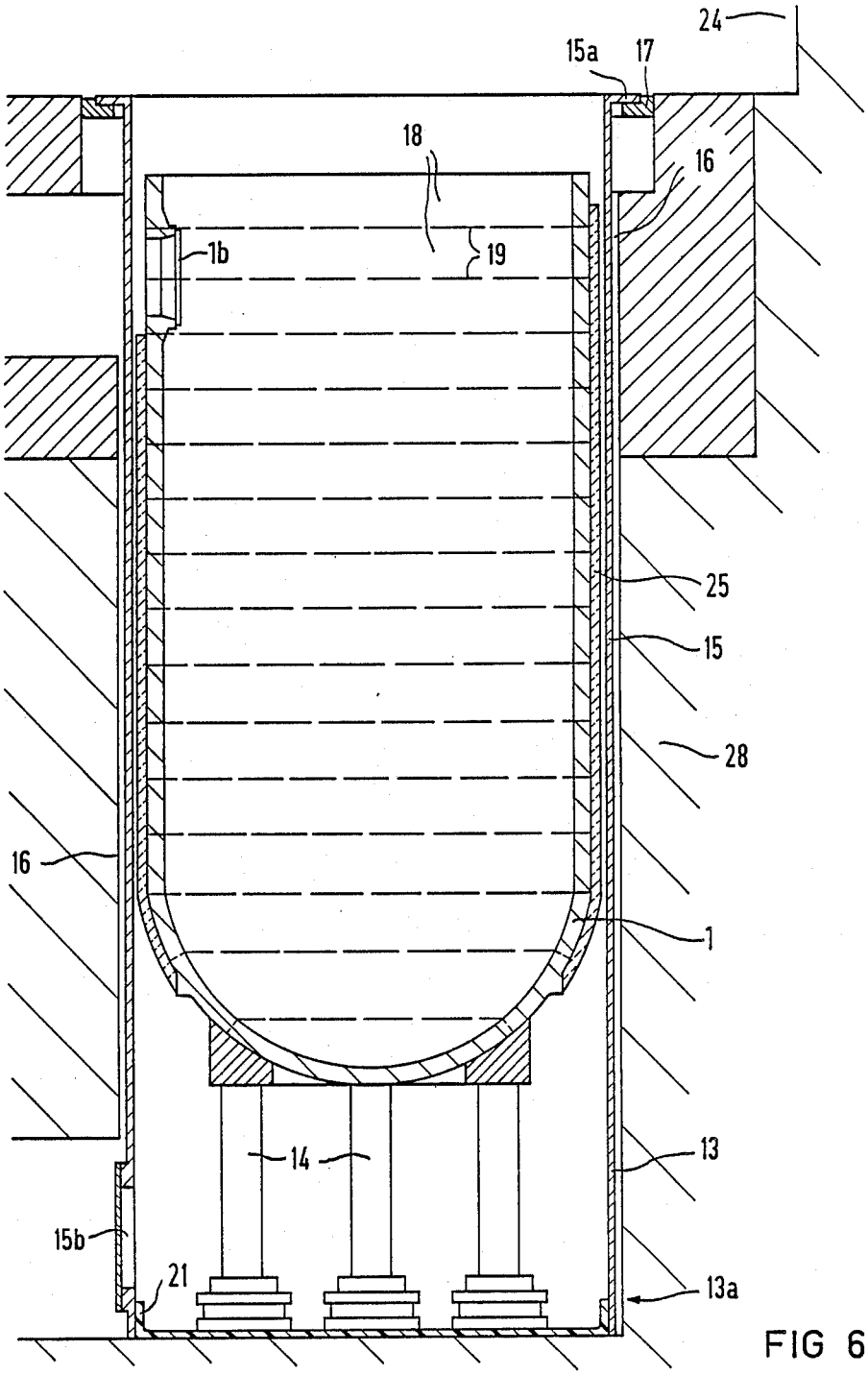
FIG. 6 is a fragmentary cross-sectional view of an apparatus for a reactor pit formed of an enclosure tube, the reactor pit serving as a flooding pool.

Instead of the steel bottom plate 13, a tub or tank-like bottom plate in the form of a lining 21 formed of plastic, such as epoxy resin with a glass-fiber laminate, can be disposed on the bottom of the reactor pit after an enclosure tube 15 with a manhole 15*b* has been introduced, as seen in FIG. 6. The plastic lining 21 is drawn upward somewhat at the lower end of the enclosure tube 15, to provide suitable sealing.

Figure 7:
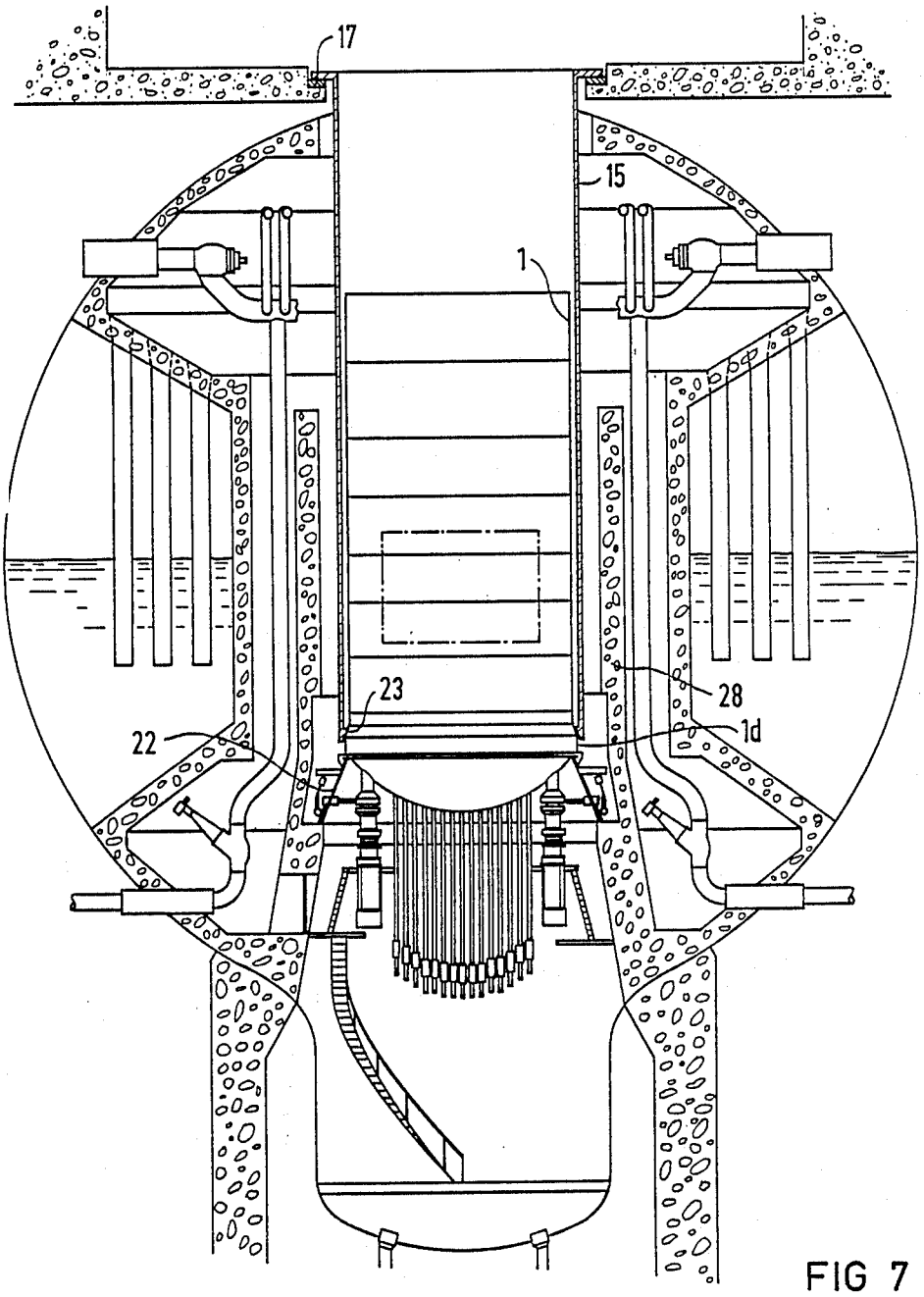
FIG. 7 is a fragmentary cross-sectional view of another reactor pressure vessel with an enclosure tube which is tightly attached to the pressure vessel in the lower region of the reactor.

Another possibility is shown in FIG. 7, which shows a boiling water reactor, which is supported by a pedestal frame 22. In this case, after severing all of the parts that would hinder the installation of the enclosure tube 15, the enclosure tube 15 is disposed between the biological shield 28 and the pressure vessel 1. The enclosure tube 15 is joined tightly to the bottom 1*d* of the reactor pressure vessel 1 by welding or by casting with sealing compound 23, especially a rubber compound. The reactor pressure vessel 1 can then be dismantled mechanically or by use of an arc saw under water, down to the bottom 1*d*. The bottom 1*d* itself can be further disassembled while dry, for instance, because the activity is low. This variation is possible wherever the vessel bottom 1*d* is supported. It is suitable for the connection of the enclosure tube 15 with the reactor pressure vessel 1 to be disposed just above the pressure vessel support or brace (pedestal frame 22).

The enclosure tube, which is shortened at the top, can remain in the reactor pit after the installation of a new reactor.

We claim:

1. Method for the wet dismantling of radioactively contaminated or activated components of nuclear reactor plants, which comprises enclosing an individual component with a jacket at the end of the service life of the component, providing a sheathing between the individual component and the jacket, flooding the individual component with water for radiation shielding, at least partly dismantling the individual component into individual pieces through a material removing method, temporarily storing the individual pieces in the sheathing, and removing the individual pieces from the sheathing to a permanent storage location, the sheathing having a thickness sufficient to support at least part of the individual component after dismantling the individual component into individual pieces.

2. Method according to claim 1, which comprises thickening the sheathing to the point where it performs the supporting function of a receptacle tank for at least part of the component after dismantling the component into individual pieces.

3. Method according to claim 1, which comprises casting the jacket.

4. Method according to claim 1, which comprises injection molding the jacket.

5. Method according to claim 1, which comprises shaping the jacket in the form of an enclosure tube.

6. Method according to claim 1, which comprises providing the component with a framework or skeleton of a reinforcement network before providing the sheathing.

7. Method according to claim 1, which comprises performing the step of dismantling the component from inside by means of chemical or electrochemical erosion.

8. Method according to claim 1, which comprises cleaning the water during the dismantling step with a water cleaning system.

9. Method for the wet dismantling of a radioactively contaminated or activated reactor pressure vessel disposed inside a reactor pit and spaced from a concrete biological shield defining a gap between the pressure vessel and the shield, which comprises severing coolant lines and closing connector stumps of the reactor pressure vessel at the end of the service lift of the pressure vessel, subsequently filling the gap between the pressure vessel and the shield by casting or injection molding forming a sheathing, flooding the pressure vessel with water for radiation shielding, at least partly dismantling the pressure vessel into individual pieces through a material removing method, temporarily storing the individual pieces in the sheathing, and removing the individual pieces from the sheathing to a permanent storage location, the sheathing having a thickness sufficient to support at least part of the pressure vessel after dismantling the pressure vessel into individual pieces.

10. Method according to claim 9, which comprises thickening the sheathing to the point where it performs the supporting function of a receptacle tank for at least part of the pressure vessel after dismantling the pressure vessel into individual pieces.

11. Method according to claim 9, which comprises casting the jacket.

12. Method according to claim 9, which comprises injection molding the jacket.

13. Method according to claim 9, which comprises shaping the jacket in the form of an enclosure tube.

14. Method according to claim 9, which comprises cleaning the water during the dismantling step with a water cleaning system.

* * * * *